US005467704A

United States Patent [19]

Mencarelli et al.

[11] Patent Number: 5,467,704

[45] Date of Patent: Nov. 21, 1995

[54] WASTE CONTAINER REFORMER AND METHOD FOR REFORMING WASTE CONTAINERS

[75] Inventors: Ron Mencarelli, Cayce; Jeffry P. Sasko, Lexington, both of S.C.

[73] Assignee: Alaron Corporation, Columbia, S.C.

[21] Appl. No.: 300,327

[22] Filed: Sep. 2, 1994

[51] Int. Cl.[6] ..... B30B 9/02

[52] U.S. Cl. ..... 100/131; 72/367; 100/215; 100/218; 100/232; 100/233; 100/271; 100/902

[58] Field of Search ..... 72/367, 394; 100/131, 100/215, 218, 223, 232, 233, 271, 902; 413/78

[56] References Cited

U.S. PATENT DOCUMENTS

| | | | |
|---|---|---|---|
| 2,305,945 | 12/1942 | Williams et al. | 264/1 |
| 2,995,999 | 8/1961 | Holt | 100/233 |
| 3,733,675 | 5/1973 | Diederich | 29/403 |
| 4,080,887 | 3/1978 | Larsen | 100/35 |
| 4,083,394 | 4/1978 | Heikkinen et al. | 157/1.21 |
| 4,086,850 | 5/1978 | Becker et al. | 100/42 |
| 4,385,556 | 5/1983 | Suzuki | 100/218 |
| 4,441,415 | 4/1984 | Hawkins | 100/215 |
| 4,516,489 | 5/1985 | Ballo | 100/902 |
| 4,601,238 | 7/1986 | Davis | 100/902 |
| 4,610,199 | 9/1986 | Pols | 100/269 |
| 4,995,314 | 2/1991 | Buer | 100/902 |
| 5,105,736 | 4/1992 | Morris | 100/53 |
| 5,129,318 | 7/1992 | Zimmer | 100/223 |
| 5,307,739 | 5/1994 | Gourdal | 100/131 |

FOREIGN PATENT DOCUMENTS

| | | | |
|---|---|---|---|
| 3285713 | 12/1991 | Japan | 72/367 |
| 1745564 | 7/1992 | U.S.S.R. | 100/902 |

*Primary Examiner*—David Scherbel
*Assistant Examiner*—Terrence R. Till
*Attorney, Agent, or Firm*—Michael A. Mann

[57] ABSTRACT

A waste container reformer, for reforming generally disk-shaped compacted waste containers into prismatic forms, sequentially presses the sides of the waste container into a prism with a 45°–90°–45° triangular base so that when it is placed adjacent to another reformed container, the two form a rectangular box for more efficient use of storage space. The pressure surfaces are controlled by hydraulic cylinders to provide the forces needed to reform the container. The reforming process is controlled so that one angle is formed at a time, beginning with one of the 45° angles, followed by the 90° angle, and then completed by forming the other 45° angle. By forming one angle at a time, the load requirements of the reformer are reduced, and a consistently similar shaped reformed waste container is created.

17 Claims, 3 Drawing Sheets

92
10
90
42
46
40
48
14
20
94
44
70
12
74
58
52
80
30
100
102
34
104
72

40
46
48
30
92
42
70
10
20
96
94
52
58
80
34
32
102
104
100
72

10
92
40
48
20
94
96
80
74
70
58
46
52
32
102
16
42
104
100
30
34
72

WASTE CONTAINER REFORMER AND METHOD FOR REFORMING WASTE CONTAINERS

BACKGROUND OF THE INVENTION

1. Field of the Invention

This invention generally relates to processing wastes for storage and disposal. In particular, the present invention relates to reforming waste containers, including already compacted wastes, for more efficient use of storage space.

2. Discussion of Background

The disposal of all types of wastes, including radioactive and hazardous wastes, is a significant problem. Environmental concerns about the stability of waste destined for disposal or long term storage has led many to a variety of solutions in order to better handle the increasing volumes of waste being produced. Waste volumes can be reduced by incinerating or recycling, thus decreasing the amount of waste going to disposal sites or to long-term storage. However, there is still a large amount of waste that can be neither recycled nor incinerated.

In addition to the stability and volumes of the various wastes in storage, there is a concern about the efficient use of the space the waste occupies at a disposal site. The price charged for disposal, which includes taxes levied by the state and local governments, frequently includes a component that is based on the volume of waste to be disposed of as an easily-measured aspect of the waste and as a way to encourage waste generators to reduce this volume.

After implementation of programs reducing the relative amount of waste generated and processing the waste to separate waste from non-waste so that only the former is disposed of, the volume of wastes can be reduced by compaction. The waste material is placed in containers such as standard 55-gallon drums which are then placed in compactors. The compactors use hydraulic rams to squeeze the air out of the drummed waste, thus increasing its weight density. For example, Morris, in U.S. Pat. No. 5,105,736, discloses a compaction apparatus for metallic drums, and Pols, in U.S. Pat. No. 4,610,199, discloses a hydraulic press for compacting drums containing radio-active wastes. The output of these compactors is a thick, roughly disk-shaped, crushed drum, generally called a puck. Sometimes these pucks are placed in overpacks, such as other drums or boxes, for disposal or long term storage.

Once the overpacks or boxes are filled, they are buried in landfills or stored in repositories. However, the nature of the circular pucks does not lead to their efficient packing in rectangular overpacks, because they leave unused space between them.

There is a need to further reduce the amount of space required for disposal or storage of waste that is not presently being met by volume reduction and compaction, and the less-than-efficient packing of waste containers with already-compacted waste pucks has led to the present invention which shall now be summarized.

SUMMARY OF THE INVENTION

According to its major aspects and briefly described, the present invention is a method and apparatus for reforming waste containers into shapes that can be stored in adjacent relation with other similarly-shaped containers with little or no space remaining between the containers. This invention is especially suited to the reforming of waste drums that have already been compacted and those that have a circular cross-section. After undergoing the reforming process, the reformed waste containers preferably are in the shape of a prism with a right triangular base.

The reformer comprises a reforming, arm, a stationary arm, and a mounting arm. The reformer arm and the stationary arm are pivotally mounted to the end of the mounting arm and rotate about this point. The reforming arm comprises an upper arm and a forearm, to make an analogy to a human arm, and pivotally connected so that each forms one of the equal sides of the prism.

Extending from the end of the stationary arm to the upper arm is a hydraulic cylinder, which provides power and control for the reforming process. Additionally, there is another hydraulic cylinder extending from the opposite end of the stationary arm to the mounting arm. This cylinder rotates the reforming arm and the stationary arm, so that once the waste container is reformed, it can be removed.

The reformer also comprises a top and bottom pressure surface which prevent the axial expansion of the waste container during the reforming process. The bottom pressure surface is a base table suitable to hold the container and to carry the mounting arm, reforming arm, and stationary arm. The top pressure surface is in the form of a 45°–90°–45° right triangle and extends from the mounting arm by a hydraulic cylinder. An additional use of the top pressure surface is that it can be actuated once the reforming process is completed to help release the reformed waste container from the arms.

Additionally, the container reformer is controlled by a computer operating through hydraulic interlocks and sensors so that the components move in the correct sequence.

An important feature of the present invention is the shape of the reformed container. In its preferred embodiment, the waste container is reformed into a prism with its base being a 45°–90°–45° right triangle. This shape allows two units of waste to be placed "hypotenuse to hypotenuse" so that, together they form a rectangular box. Other pairs of units can then be stacked on top or placed adjacent to each other in order to closely pack the waste units in an array, with minimal space therebetween. Compared to drummed waste with a circular cross-section, the reformed waste containers occupy at least 11% less volume, a substantial reduction.

Another important feature of the present invention is the controlled-sequential reforming process the container undergoes. The use of a single hydraulic cylinder to power the process adds to the stability and control needed to perform such a task. By using a two part reforming arm to press the cylinder against a stationary arm, and by forming one angle at a time, the reforming process is controlled for consistent results. Inconsistent results will erode the volume reduction quickly. By reforming the container so that the angles are formed one at a time, the load requirements are greatly reduced, allowing the use of smaller dimensioned members and cylinders than would otherwise be necessary.

Additionally, this controlled-sequential reforming process has the ability to reform the container so that it fills the corners of the prism. It is necessary for the reforming process to consistently make substantially similar shaped containers so that there is an efficient use of space. The most critical dimension of the reformed container is the hypotenuse, because if the hypotenuse's length is different from the one it is adjacent, there will be a greater impact on the amount of space not filled than if another leg of the prism is formed inconsistently.

Another feature of the present invention is the use of stainless steel contact surfaces on the reforming and stationary arms. During the reforming process it is possible that the contact surfaces will come into contact with material contained within the waste containers. However, the use of stainless steel prevents the corrosion and degradation that might otherwise affect these surfaces.

Still another feature of the present invention is the catch basin positioned below the support table. The waste containers contain various forms of waste, some of which could be flowable. During the reforming process, it is possible for the flowable material to escape the bounds of the container. However, the catch basin is positioned to safely catch the material for later collection.

Another feature of the present invention is the loading device used to position a container to be reformed. This device comprises a conveyer and a positioning cylinder. The conveyor brings the waste containers from a loading point to a point near the reforming and stationary arms. When the reformer is ready, the positioning cylinder moves the waste container into contact with the pressure surfaces so that it may be reformed.

Yet another feature of the present invention is the unloading method for the reformed waste container. Once the container has been reformed, the cylinder attached to the stationary arm and the mounting arm operates to rotate the reforming arm and the stationary arm over the platform. This platform is supported by a scissors-jack operated by another cylinder. With the platform in its highest position, the reformed container is released from the reforming arm and stationary arm. Optionally, the cylinder attached to the top pressure surface may be used to facilitate the container's removal from the arms. Once the container has been released, the scissors-jack cylinder operates to lower the platform. The reformed container descends on the platform until contacting another conveyor which carries the container to an area for further handling.

Other features and advantages of the present invention will be apparent to those skilled in the art from a careful reading of the Detailed Description of A Preferred Embodiment accompanied by the following drawings.

DETAILED DESCRIPTION OF A PREFERRED EMBODIMENT

Figure 1:
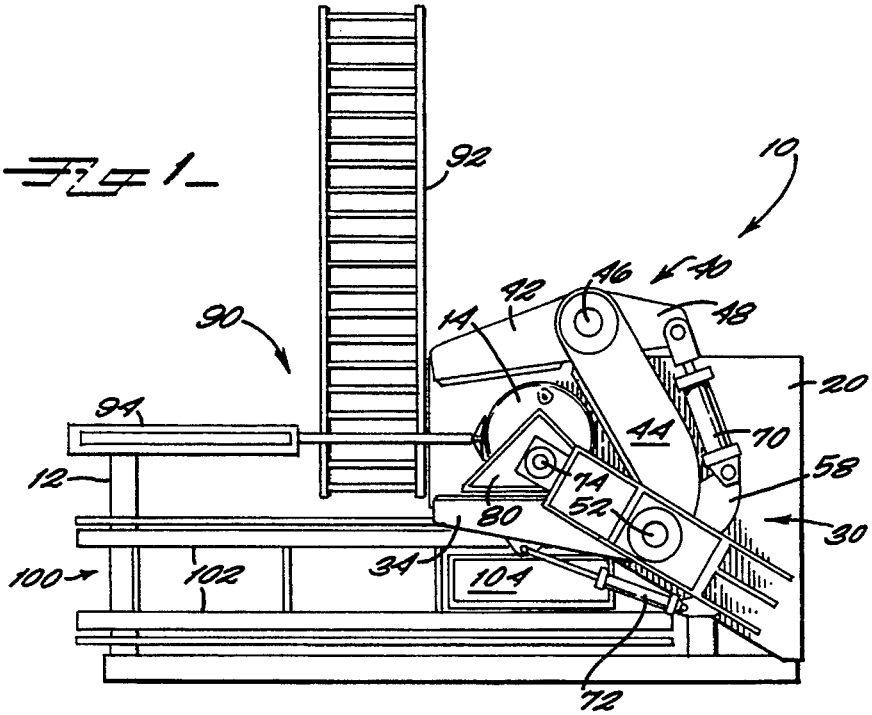
FIG. 1 is a top view of the container reformer during the loading process according to the preferred embodiment of the present invention.

In the following description similar components are referred to by the same reference numeral in order to simplify the understanding of the sequential aspect of the drawings.

Referring now to FIGS. 1, 2, 3, and 4, a waste container reformer 10 in its preferred embodiment comprises crushing arms 30, a loading device 90, an unloading device 100, and a frame 12. These various devices operate in combination to reform waste container 14 into a reformed waste container 16 which is in the shape of a prism with a right triangular base. "Reforming" here means to change the shape without necessarily changing the volume. By changing the shape, containers can be positioned next to each other more efficiently, leaving much less space between them.

Crushing arms 30 comprise a mounting arm 32, a stationary arm 34, and reforming arms 40. Reforming arms 40 have two parts, an upper arm 42 and a forearm 44, using a human arm as an analogy. Connected to upper arm 42 and stationary arm 34 is a reforming cylinder 70 which operates the arms to reform waste container 14. A rotating cylinder 72 is connected to stationary arm 34 and mounting arm 32 so that reformed waste container 16 can be removed, once the reforming process is completed. Both reforming cylinder 70 and rotating cylinder 72 are preferably hydraulic cylinders.

Figure 8:
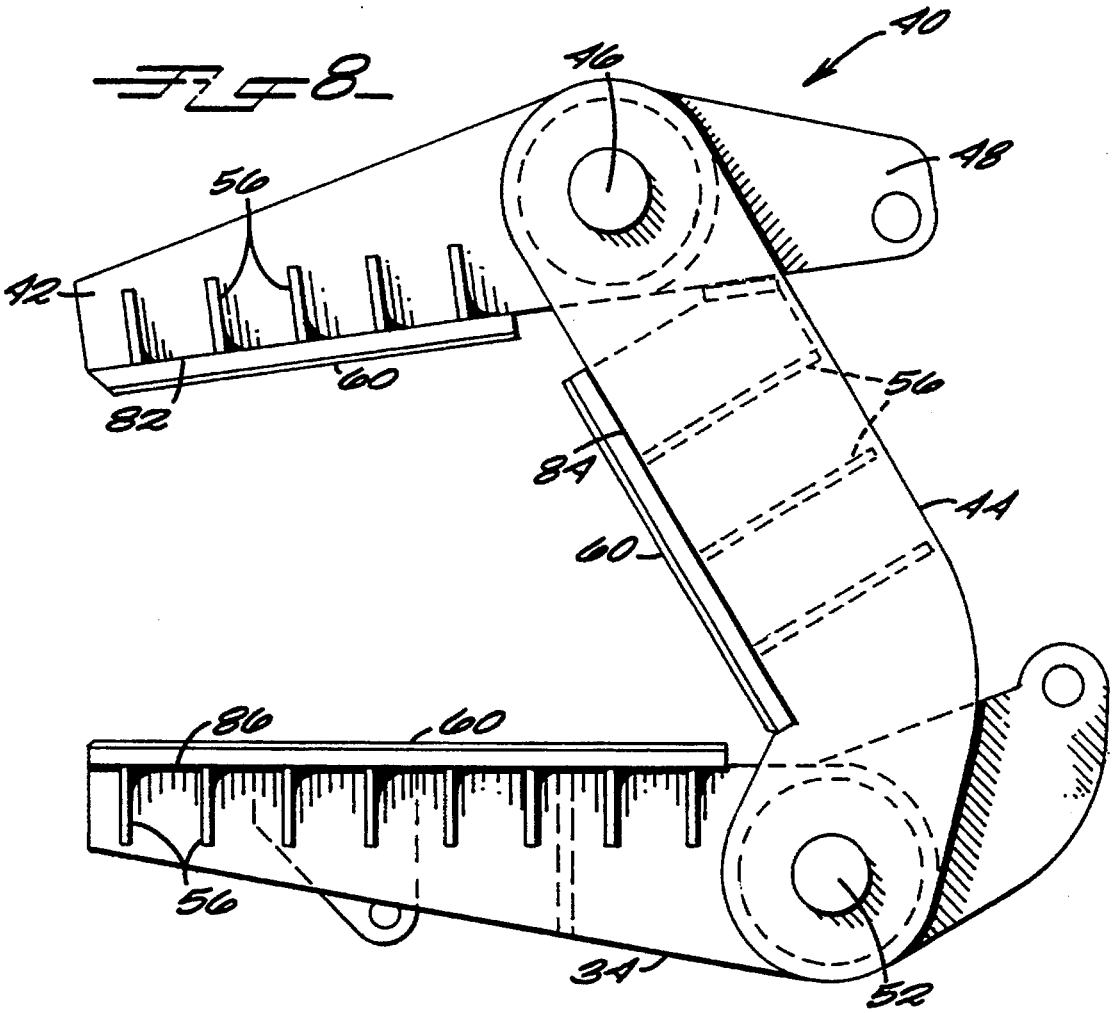
FIG. 8 is a detailed top view of the reforming arms and stationary arm according to the preferred embodiment of the present invention.
Figure 9:
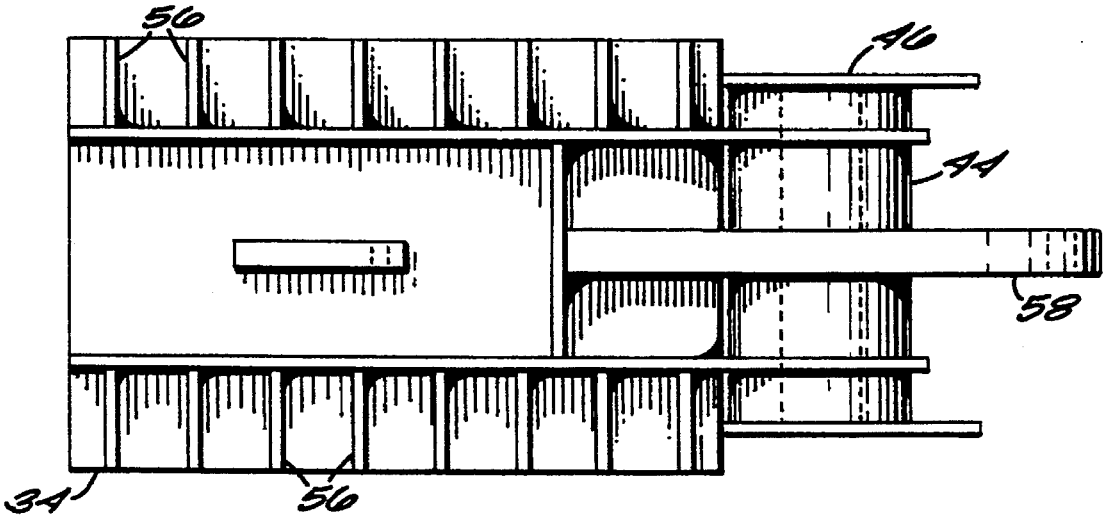
FIG. 9 is a detailed side view of the reforming arms and stationary arm according to the preferred embodiment of the present invention.

Upper arm 42 consists essentially of various sizes of plates, preferably made of steel, comprising an elongated structure with a front face 82 that has a height equal to at least the height of waste container 14. (See especially FIGS. 8 and 9). Along the back of upper arm 42 are trusses 56 to add stability and strength. At one end of upper arm 42 is a pivotal connection 46 that mates with forearm 44. Extending perpendicularly from the same end of upper arm 42 as pivotal connection 46 and extending from its midsection is a flange 48. Reforming cylinder 70 is connected to upper arm 42 at flange 48 and extends to stationary arm 34, via member 58.

Forearm 44 consists essentially of various sizes of preferably steel plates composing an elongated structure with a front face 84 that has a height equal to at least the height of waste container 14. (See especially FIGS. 8 and 9). Along the back of forearm 44 are trusses 56 to add stability and strength while avoiding massiveness in the plates. Located on the ends of forearm 44 are pivotal connections 46 and 52. Upper arm 42 and forearm 44 are connected at pivotal connection 46 and rotate with respect to each other during the reforming process. At pivotal connection 52, forearm 44 is pivotally connected to mounting arm 32 and stationary arm 34 so that during the removal process, reforming arm 40 and stationary arm 34 rotate with respect to mounting arm 32.

Stationary arm 34 consists essentially of various sizes of preferably steel plates composing an elongated structure with a front face 86 that has a height equal to at least the height of waste container 14. (See especially FIGS. 8 and 9). Along the back of stationary arm 34 are trusses 56 to add stability and strength. At one end of stationary arm 34 is a pivotal connection 52. Extending perpendicularly from the same end of stationary arm 34 as pivotal connection 52 and extending from its midsection is a member 58. Connected to member 58 is reforming cylinder 70 which extends to flange 48 of upper arm 42. Connected to the back side of stationary arm 34 is rotating cylinder 72 which extends so that it is connected to mounting arm 32. In operation, rotating cylinder 72 contracts to rotate crushing arms 30 about pivotal connection 52, so that they are in the unloading position.

Covering each of the front faces of forearm 44, upper arm 42, and stationary arm 34 is a stainless steel contact surface 60, 62 and 64, respectively. (See especially FIGS. 8 and 9). During the reforming process, it is possible that material contained inside waste container 14 could leak out. By using stainless steel contact surfaces 60, any sort of corrosion or degradation to the container reformer 10, that would normally occur, is kept to a minimum.

Mounting arm 32 consists essentially of L-shaped steel plates in the form of an upside-down block L. Located on the under side of mounting arm 32 is a pivotal connection 52 where forearm 44 and stationary arm 34 are pivotally mounted. Attached to the face of the short end of mounting arm 32 is a discharge plunger cylinder 74, which is preferably hydraulically operated. Positioned on the end of discharge plunger cylinder 74 is a discharge plunger 80. Discharge plunger 80 generally comprises a steel plate dimensioned similar to the final prism shape of reformed waste container 16. In operation, discharge plunger 80 is positioned to prevent axial expansion of waste container 14 in an upward direction during the reforming process. Additionally, discharge plunger 80 may be used to help remove reformed waste container 16 from crushing arms 30 during the unloading process.

Reforming arms 40, stationary arm 34, and mounting arm 32 are generally attached to frame 12. Also, part of frame 12 is a base table 20 that supports waste container 14 and prevents its axial expansion in a downward direction during the reforming process. Also mounted to frame 12 is a catch basin 22. During the reforming process flowable material or other residue might escape from waste container 14. Catch basin 22 is positioned to collect this material so that it may be disposed of properly.

Upper arm 42, forearm 44, stationary arm 34, plunger 80 and base table 20 are referred to as pressure surfaces. A pressure surface as defined herein is a surface that is actuated to impart a pressure upon waste container 14, or a surface that receives pressure from, and provides confinement for, waste container 14.

Figure 4:
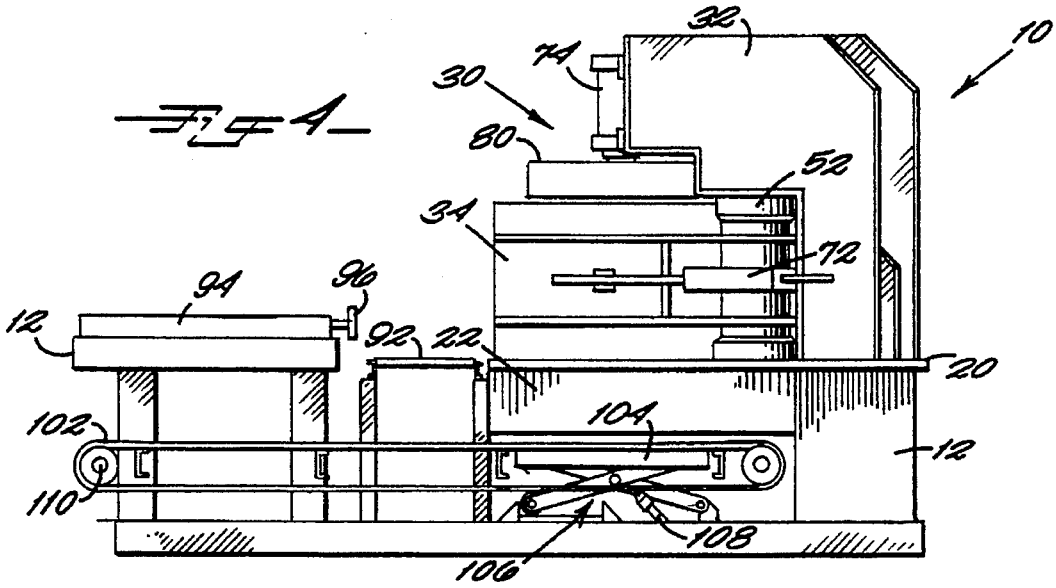
FIG. 4 is a side view of the container reformer of FIG. 1 according to the preferred embodiment of the present invention.
Figure 5:
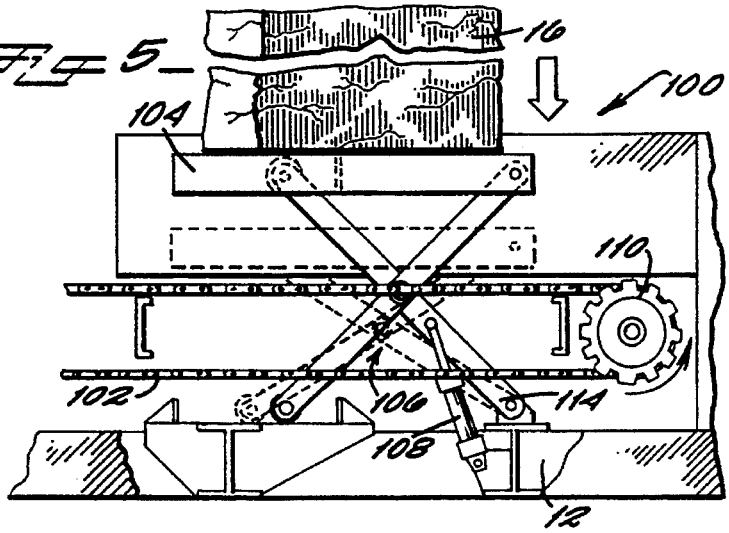
FIG. 5 is a detailed side view of the container reformer during the unloading process with the platform raised according to the preferred embodiment of the present invention.
Figure 6:
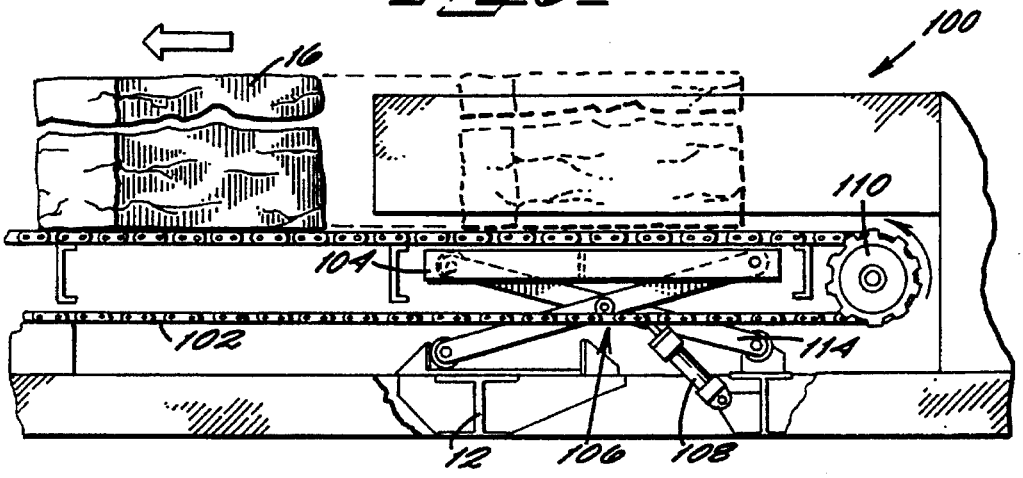
FIG. 6 is a detailed side view of the container reformer during the unloading process with the platform lowered according to the preferred embodiment.

Referring now to FIG. 4, 5, and 6, loading device 90 comprises an inlet conveyor 92, a piston cylinder 94, and a container contact 96. Inlet conveyor 92 is any commercial conveyor assembly dimensioned to carry waste container 14. Located perpendicular to conveyor 92 and supported by frame 12 is piston cylinder 94. Mounted on the end of piston cylinder 94 is container contact 96. In operation, waste container 14 is loaded onto conveyor 92 from a loading area and is moved along conveyor 92 until it reaches a position lateral to container contact 96. Piston cylinder 94 actuates so that container contact 96 meets waste container 14 and moves it to a position proximate to stainless steel contact surfaces 60 of reforming arms 40 and stationary arms 34. Piston cylinder 94 then retracts so that container contact 96 is withdrawn before reforming arms 40 and stationary arm 34 operate.

Unloading device 100 consists essentially of an exit conveyor 102, a platform 104, a scissors-jack 106, and an operating cylinder 108. Platform 104 is attached to scissors-jack 106, which is generally in an "X"-formation. Scissors-jack 106 comprises two elongated members pivotally connected at their midpoints. Operating cylinder 108 is attached at one end to frame 12 and to a leg 114 of scissors-jack 106, so that as cylinder 108 extends during operation, platform 104 rises. Exit conveyor 102 comprises two parallel belts in spaced relation driven about rotating gears 110. The belts are in spaced relation so that there is a gap between the two, through which platform 104 and scissors-jack 106 can pass. Once waste container 14 has been reformed, rotating cylinder 72 operates to rotate reforming arms 40 and stationary arm 34 about pivotal connection 52. With platform 104 in its raised position and reforming arms 40 and stationary arm 34 positioned over platform 104, discharge plunger cylinder 74 actuates to release reformed waste container 16 onto platform 104. Operating cylinder 108 then retracts so that platform 104 descends until reformed waste container 16 contacts exit conveyor 102, where it is carried away to an unloading area.

Figure 7:
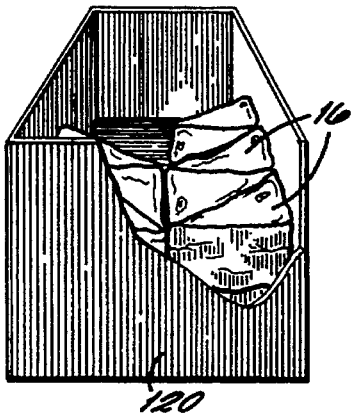
FIG. 7 is a perspective view of a rectangular storage container with an array of reformed waste containers according to the preferred embodiment of the present invention.

When waste containers are used for disposal or long term storage, efficient use of container volume is critical. Typically, waste containers are cylindrical in form, and placing them in rectangular storage containers inherently leaves unused space. Waste container reformer 10 preferably reforms waste container 14 into reformed waste container 16 so that it is in the shape of a prism with a 45°–90°–45° triangular base. When two reformed waste containers 16 are placed adjacent to one another, they form a box or cube. Other pairs of reformed waste containers 16 may also be placed in adjacent relation, thus forming a 3-dimensional close packed array of reformed waste containers 16, where very little available space is wasted. In practice, reformed waste containers 16 can be stacked and arranged in a typical storage container 120, so that substantially all the available space is used. (See especially FIG. 7). In fact, by reforming waste containers 14 from a cylindrical shape into a right triangular prism, it has been found that at least an 11% savings in volume may be gained in a storage container.

Figure 2:
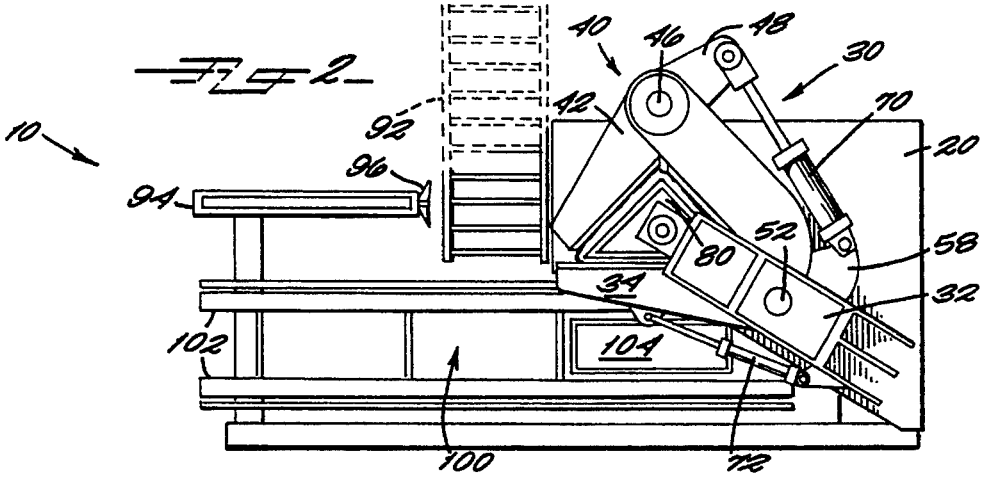
FIG. 2 is a top view of the container reformer of FIG. 1 during the reforming process.
Figure 3:
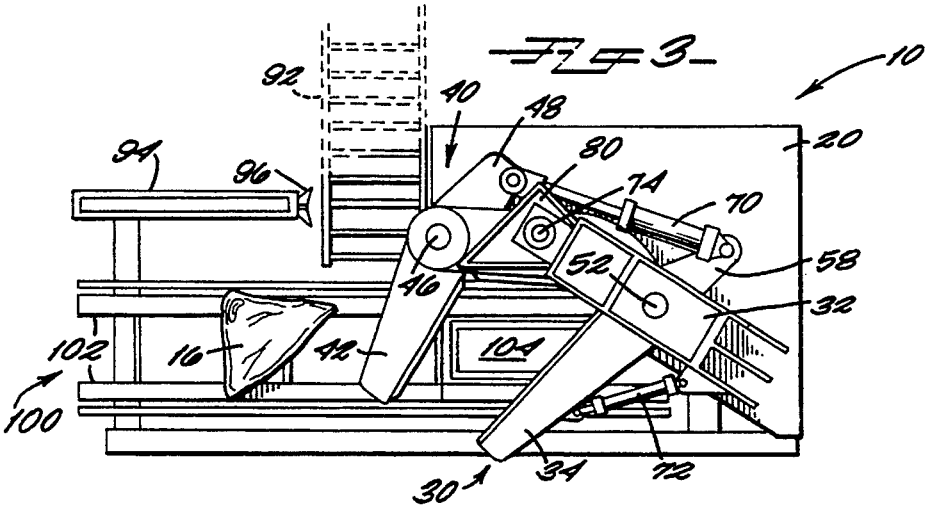
FIG. 3 is a top view of the container reformer of FIG. 1 during the unloading process.

The sequential control of the reforming process is essential in order to have precisely-shaped reformed waste containers 16. As best seen in FIGS. 1, 2, and 3, the use of only one reforming cylinder 70 permits the crushing arms 30 to work in conjunction so that selected angles of the reformed waste container 16 are constructed before the others. In operation, upper arm 42 holds waste container 14 while forearm 44 and stationary arm 34 pinch the container to form the first 45° corner. After this corner has been completed, the 90° corner, between upper arm 42 and stationary arm 34, is formed. Finally, the final 45° corner is formed between upper arm 42 and stationary arm 44. By performing the operation in this manner a substantially smaller amount of energy is needed than would have been necessary if all sides and corners were formed simultaneously. Therefore, the reforming cylinder 70 and the various crushing arms 30 may be dimensioned smaller and still accomplish the same task.

Another reason to maintain consistency in the shape of reformed waste container 16 is that a different sized leg of reformed waste container 16 would interfere with the efficiency in which they could be stacked. This is especially true of the side that is the hypotenuse because of its greater length and position in the stacked array.

It will be apparent to those skilled in the art that many modifications and substitutions can be made to the foregoing preferred embodiment without departing from the spirit and scope of the present invention, which is defined by the appended claims.

What is claimed is:

1. Apparatus for reforming a waste container for storage and disposal, said apparatus comprising:

a frame;

at least five pressure surfaces carried by said frame; and means for applying said at least five pressure surfaces to a waste container to reform said waste container so that said reformed waste container is of a shape having only flat surfaces and has substantially the same volume as said waste container before being reformed, at least one of said at least five pressure surfaces preventing axial expansion of said container, at least one of said five pressure surfaces being movable after said waste container is reformed, said applying means carried by said frame.

2. The apparatus as recited in claim 1, further comprising means for loading said waste container into said reforming means.

3. The apparatus as recited in claim 1, further comprising means for unloading said waste container from said reforming means.

4. The apparatus as recited in claim 1, wherein said pressure surfaces reform said waste container into a shape arrangable in a close packed array.

5. The apparatus as recited in claim 1, wherein said pressure surfaces reform said waste container into a prism that has a right triangular base.

6. The apparatus as recited in claim 1, wherein said apparatus further comprises a catch basin to collect any liquid released from said waste container during said reforming process.

7. Apparatus for reforming a waste container for storage and disposal, said apparatus comprising:

a frame;

at least four pressure surfaces in spaced relation to each other and carried by said frame;

means for applying said at least four pressure surfaces to waste container to reform said container into a shape that permits said reformed containers to make up a close packed array, said applying means carried by said frame; and means for moving said waste container proximate to said at least four pressure surfaces so that said applying means can apply said at least four pressure surfaces to said container, said moving means comprising a piston arm in spaced relation to said applying means.

8. The apparatus as recited in claim 7, wherein said moving means further comprises:

means to convey said waste container; and means to position said waste containers from said conveying means proximate to said pressure faces.

9. The apparatus as recited in claim 7, wherein said conveying means is selected from the group consisting of a conveyer belt assembly or roller bar conveyor.

10. The apparatus as recited in claim 7, wherein said apparatus further comprises:

a scissors jack;

a platform carried by said scissors jack;

means for separating said reformed waste containers from said pressure surfaces;

means for operating said scissors jack so that said platform can be raised or lowered; and said applying means moving said reformed containers over said platform when said scissors jack raises said platform to receive said reformed container.

11. The apparatus as recited in claim 7, wherein said operating means is selected from the group consisting of a pneumatic cylinder, a hydraulic cylinder, and a screw-jack.

12. Apparatus for reforming waste container for storage and disposal, said apparatus comprising:

a frame;

a reforming arm carried by said frame;

a stationary arm carried by said frame;

a mounting arm carried by said frame and in operative connection with said reforming arm and said stationary arm so that said reforming arm and said stationary arm can rotate about the end of said mounting arm;

a top pressure surface carried by said frame;

a bottom pressure surface carried by said frame;

a first pressure surface carried by said stationary arm;

a second pressure surface carried by said reforming arm;

a third pressure surface carried by said reforming arm, said second and said third pressure surfaces opposing said first pressure surface;

power means to move said reforming arm so that said second and third pressure surfaces are brought into engagement with a waste container, said container being held between said top pressure surface and said bottom pressure surface and reformed waste container is of a shape that has only flat surfaces and has substantially the same volume as said waste container before being reformed, said power means carried by said frame.

13. The apparatus as recited in claim 12, wherein said shape of said reformed waste container is a prism with a right triangular base.

14. The apparatus as recited in claim 12, wherein said reforming arm has an upper arm and a forearm pivotally connected, so that each makes a side of said right triangular prism.

15. The apparatus as recited in claim 12, wherein said bottom pressure surface makes said base of said prism, and said top pressure surface makes the opposite side of said prism as that of said bottom pressure surface.

16. The apparatus as recited in claim 12, wherein said power means is connected to said stationary arm and said upper arm of said reforming arm, and said power means is selected from the group consisting of a pneumatic cylinder, a hydraulic cylinder, and a screw-jack.

17. The apparatus as recited in claim 12, wherein said reforming arm and said stationary arm have stainless steel contact surfaces.

* * * * *